US006616474B2

(12) United States Patent
Aiso

(10) Patent No.: US 6,616,474 B2
(45) Date of Patent: Sep. 9, 2003

(54) BULB SOCKET

(75) Inventor: Yosiaki Aiso, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/991,440

(22) Filed: Nov. 16, 2001

(65) Prior Publication Data

US 2002/0061685 A1 May 23, 2002

(30) Foreign Application Priority Data

Nov. 17, 2000 (JP) ..... P.2000-350591

(51) Int. Cl.[7] ..... H01R 13/627
(52) U.S. Cl. ..... 439/356; 439/699.2
(58) Field of Search ..... 439/356, 349, 439/619, 350–357, 638, 699, 602, 918, 736, 854, 336, 559, 699.2; 362/226, 267

(56) References Cited

U.S. PATENT DOCUMENTS 4,764,854 A * 8/1988 Matsune et al. ..... 362/226
4,940,422 A * 7/1990 Forish et al. ..... 439/356
5,120,233 A * 6/1992 Mikola ..... 439/356
5,154,645 A * 10/1992 Harada et al. ..... 439/736
5,951,318 A 9/1999 Harada
6,083,054 A 7/2000 Suzuki et al.

* cited by examiner

*Primary Examiner*—Jean F. Duverne
(74) *Attorney, Agent, or Firm*—Koda & Androlia

(57) ABSTRACT

A bulb socket for retaining, for instance, an automobile wedge-base bulb that is comprised of a glass bulb that encloses a filament and a flat sealing element provided at the bottom of the glass bulb and having a lead wire on its flat surface, the bulb socket including a bulb retention portion and a conducting terminal provided inside the bulb retention portion. The conducting terminal that retains the flat sealing element of the bulb and is in contact the lead wire is formed with an engagement piece that engages with an engagement step formed in the cylindrical bulb retention portion, thus keeping the conducting terminal inside the bulb retention portion; and a window is opened in the bulb retention portion so that the engagement piece of the conducting terminal and the engagement step of the bulb retention portion can be seen through the window.

5 Claims, 10 Drawing Sheets

BULB SOCKET

BACKGROUND OF THE INVENTION

1. Field of the Invention

The present invention relates to a bulb socket and more particularly to a bulb socket for a wedge bulb used in, for instance, an automobile.

2. Prior Art

One of known bulb sockets is designed for retaining a wedge-base bulb therein. A wedge-base bulb generally includes a glass bulb that encloses a filament therein and a flat sealing element provided at the base of the glass bulb. A lead wire is led out from the base of the sealing element and disposed on the flat surface of the sealing element.

A bulb socket for this wedge-base bulb has a bulb retention portion for retaining the wedge-base bulb therein; and in this bulb retention portion, a conducting terminal is installed so that the conducting terminal is in contact with the lead wire and retains the sealing element of the bulb. The conducting terminal has a connector terminal; and a connector case is integrally formed with the bulb retention portion, thus forming, together with the connector terminal, a connector portion that is in the rear portion of the bulb socket.

A connector connected with a power source is coupled to the connector portion, so that the wedge-base bulb is connected to the power source via the conducting terminal.

The above-described conducting terminal is provided with an engagement piece that is formed in a cut-and-erected state. When the conducting terminal is inserted from the front end of the bulb retention portion, the engagement piece is engaged with an engagement step that is formed in the bulb retention portion. As a result, the conducting terminal is retained in the bulb retention portion.

In this prior art bulb socket, the engagement step is formed by a die that is pulled out toward an opposite side from the bulb retention portion. In other words, the die is pulled toward the connector portion so as to form the engagement step.

Since in the above-described conventional bulb socket the engagement step that is engaged with the engagement piece of the conducting terminal is formed by a die that is pulled out from the rear end of the connector portion, the engagement step is not visible from the outside. As a result, the engagement of the engagement piece of the conducting terminal and the engagement step is checked only by the feel of finger of an operator. This, however, causes reliability problems.

In addition, since the die for molding the engagement step is pulled toward the connector portion, a pull-out hole for pulling out the die is formed in a partition wall between the connector portion and the bulb retention portion. If the size of the bulb socket is reduced, an insert hole for the connector terminal formed in the partition wall overlaps with the pull-out hole for the die, or part of the side wall of the connector portion needs to be cut out so as to avoid the overlapping of the insert hole for the connector terminal and the pull-out hole for the die. This causes a problem. The shape of the connector portion is limited.

SUMMARY OF THE INVENTION

Accordingly, the object of the present invention is to provide a bulb socket that reliably retains a connection terminal therein and increases the degree of design choice.

The above object is accomplished by a unique structure for a bulb socket in which a pull-out hole for a die for molding an engagement step that extends substantially perpendicular to a direction in which a bulb is inserted is provided, and the pull-out hole is formed so as to penetrate the outer wall of a bulb retention portion of the bulb socket.

In the bulb socket of the present invention, the engagement step formed in the bulb socket can be seen from the outside through a window which is the pull-out hole. Accordingly, whether or not the engagement piece of a conducting terminal is engaged with the engagement step of the bulb socket can be easily determined through the window or the pull-out hole.

In addition, the die for molding the engagement step is pulled out in the direction nearly perpendicular to the direction in which the bulb is inserted in the bulb socket. Thus, no hole other than a terminal insert hole is formed in the partition wall between the bulb retention portion and the connector portion of the bulb socket, and the as a result design of the socket is not restricted.

DETAILED DESCRIPTION OF THE INVENTION

Embodiments of the bulb socket according to the present invention will be described below with reference to the accompanying drawings.

Figure 1:
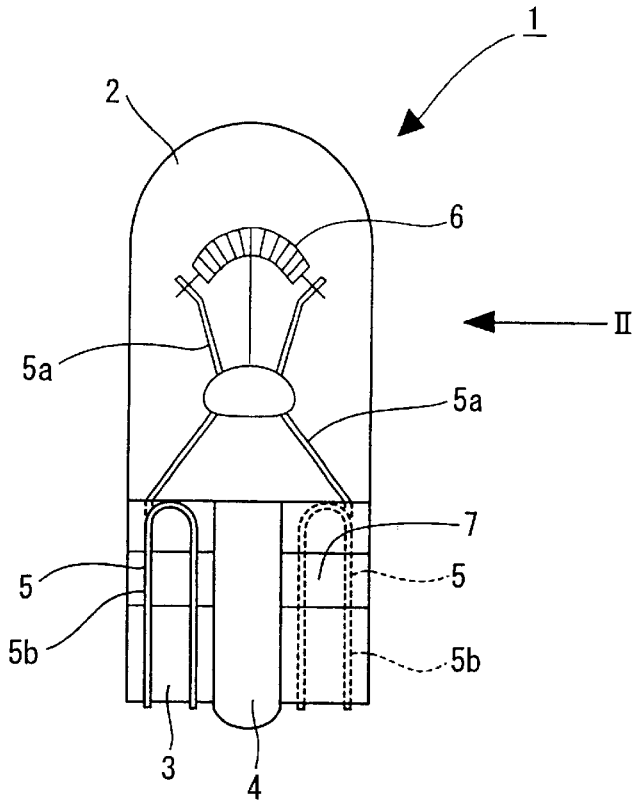
FIG. 1 is a side view of a wedge-base bulb to be retained by a bulb socket of the present invention.
Figure 2:
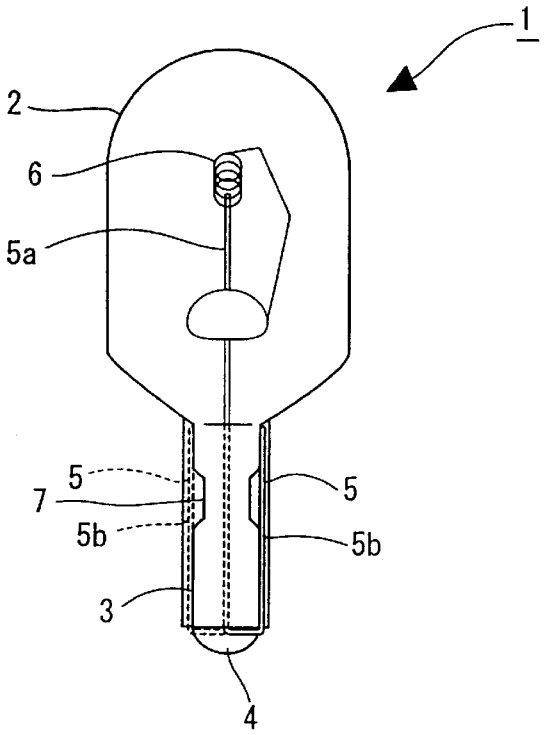
FIG. 2 is the wedge-base bulb seen in the direction of arrow II FIG. 1.

The bulb retained by the bulb socket of the present invention is a wedge-base bulb 1 as shown in FIG. 1 and FIG. 2.

The wedge-base bulb 1 comprises a glass bulb 2 and a flat sealing element 3. The glass bulb 2 is relatively short in its axial direction, has a cylindrical shape, and is closed at its one end. The flat sealing element 3 is formed so as to be continuous to the other end of the glass bulb 2. An exhaust pipe 4 is positioned at the center of the sealing element 3.

Lead wires 5 are installed in the bulb and axially penetrate the sealing element 3. Internal portions 5*a* of the lead wires 5 located inside the glass bulb 2 serve as inner wires, and both ends of a filament 6 are supported between the front ends of the internal portions 5*a*. Portions of the lead wires 5 led out of an end surface of the sealing element 3 toward the outside are disposed on the opposite flat surfaces of the sealing element 3 and serve as outer lead wires.

Furthermore, engagement grooves 7 are formed in the flat surface of the sealing element 3. The engagement grooves 7 are located on the right-hand side in FIG. 1 of the exhaust pipe 4 and borders on the glass bulb 2 (see FIG. 2).

A bulb socket 8 that received the above described bulb 1 is composed of a socket main body 9 and a conducting terminal 20.

The socket main body 9 is formed from synthetic resin by molding, and it is comprised of a hollow bulb retention portion 10 and a connector case 11 which are formed integrally.

A flange 12 is provided so as to protrude on the boundary portion between the bulb retention portion 10 and the connector case 11. Engagement protruding portions 13 are formed on an outer peripheral surface of the bulb retention portion 10 so that the engagement protruding portions 13 are located slightly on the front side of the flange 12.

Figure 5:
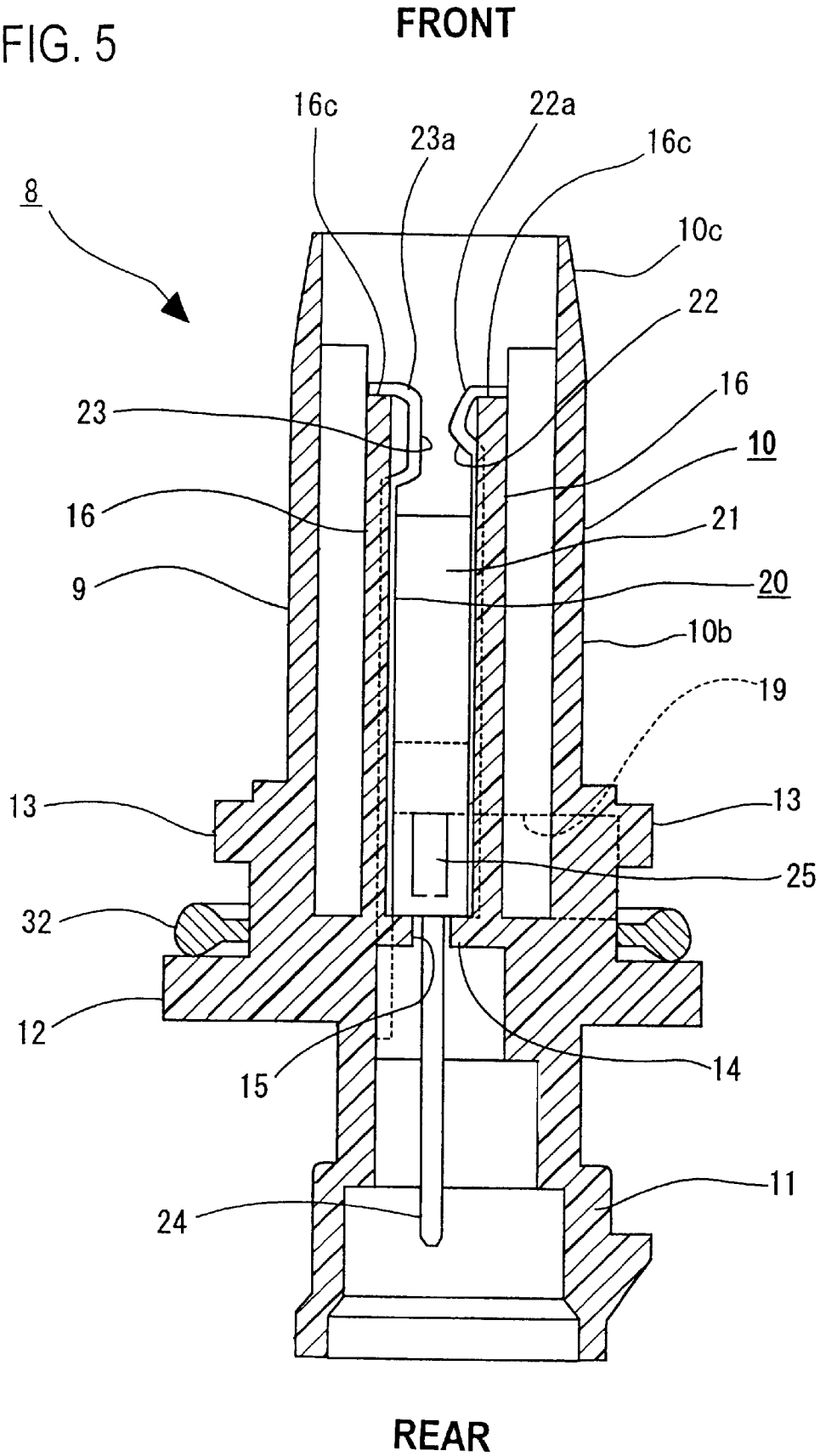
FIG. 5 is a cross sectional view taken along the line V—V in FIG. 3.
Figure 9:
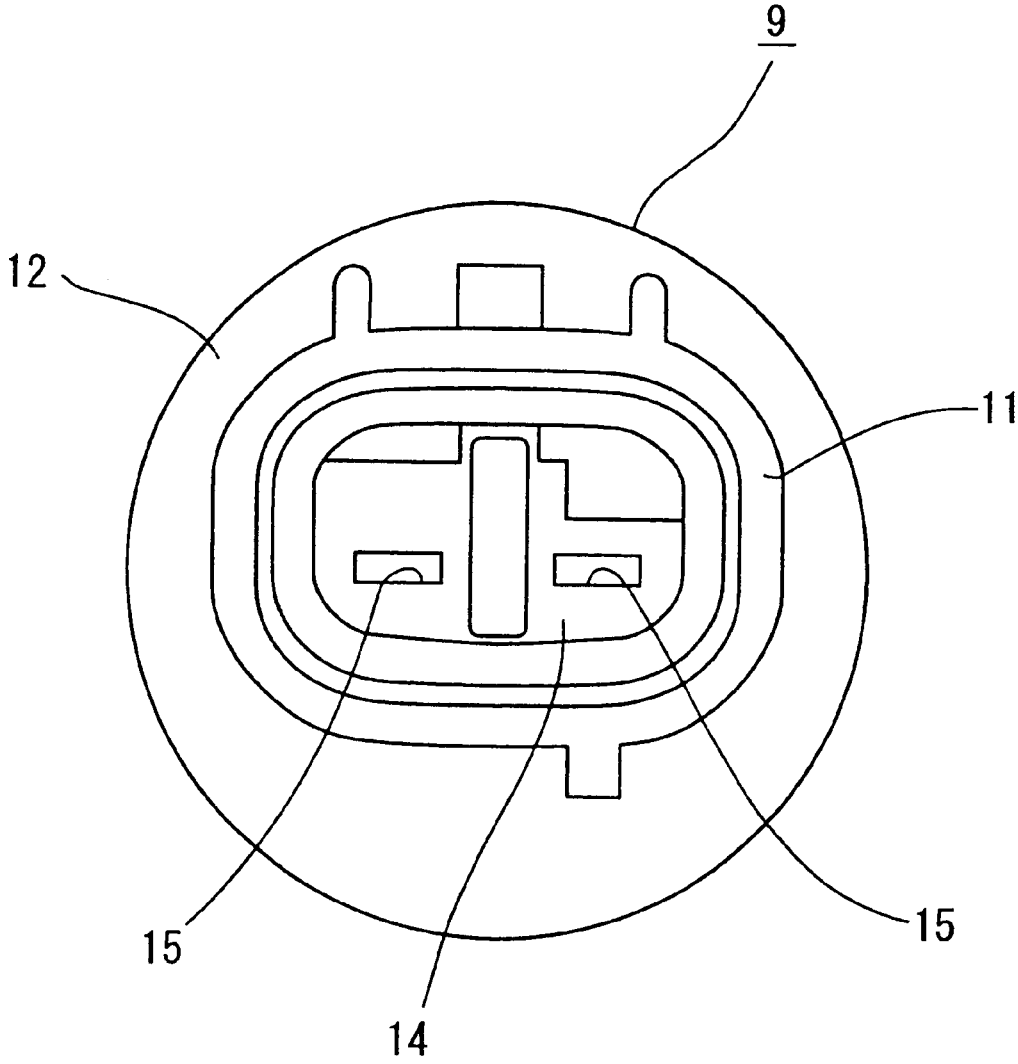
FIG. 9 shows the rear end of the socket main body.

As best seen from FIG. 5, in the socket main body 9, a partition wall 14 is formed, separating the space in the bulb retention portion 10 from the space in the connector case 11. Terminal insert holes 15 are formed in the partition wall 14 (see FIG. 7 and FIG. 9).

The bulb retention portion 10 has substantially a cylindrical shape, and a pair of dividing walls 16 that extend nearly in parallel in the axial direction of the bulb retention portion 10 are formed in the bulb retention portion 10. As seen from FIG. 7, the center portions of the dividing walls 16 slightly protrude so as to be closer to each other, and opposite surfaces 16*a* thereof are formed concave of the same curvature.

Since the center portions of the dividing walls 16 protrude inwardly so as to be closer to each other as described above, as seen from FIG. 1 shallow grooves 16*b* are formed on opposite surfaces of both ends of each one of the dividing walls 16. In addition, portions 16*c* of the front end faces of both end portions of the dividing walls 16, which are positioned on the grooves 16*b* side, serve as placement surfaces positioned slightly behind other portions.

Figure 7:
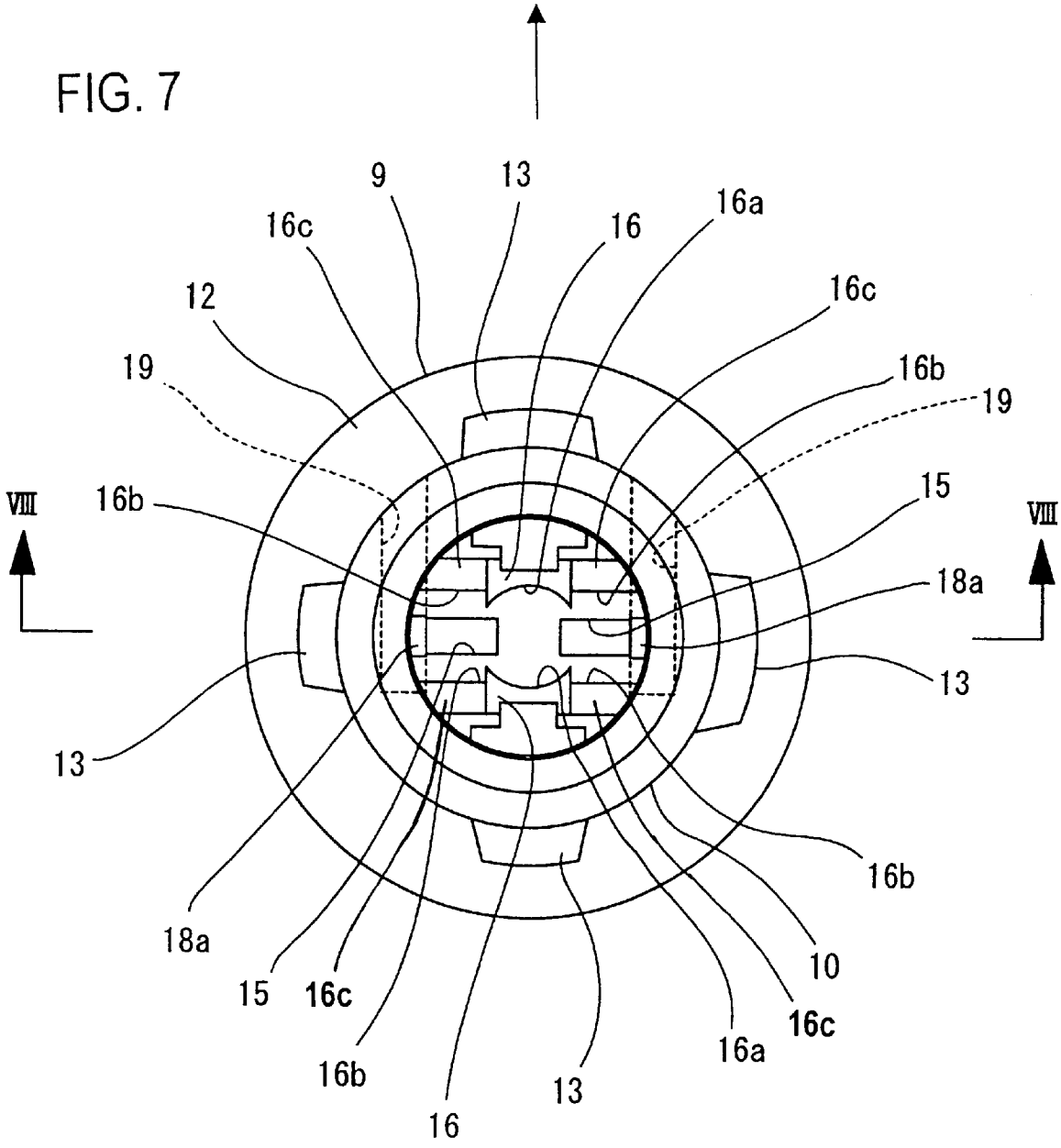
FIG. 7 shows the front end of the socket main body of the bulb socket of the present invention.
Figure 8:
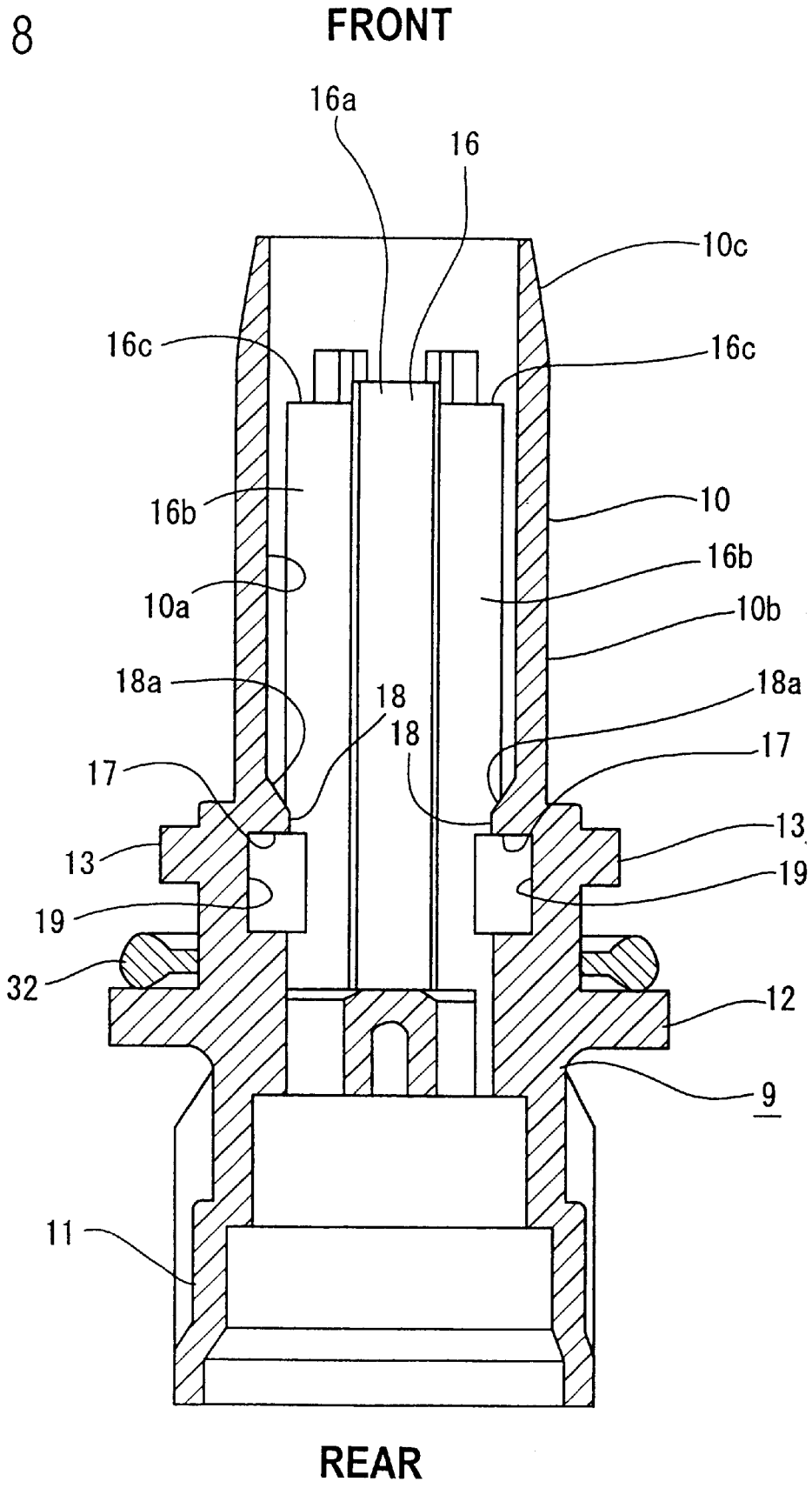
FIG. 8 is a cross sectional view taken along the line VIII—VIII in FIG. 7.

The terminal insert holes 15 are positioned at both ends of a bottom portion of a rectangular space surrounded by the dividing walls 16 (see FIG. 7 and FIG. 8).

Engagement steps 17 that face the partition wall 14 are formed on areas of an inner peripheral surface 10*a* of the bulb retention portion 10 which are surrounded by the dividing walls 16 and are close to the partition wall 14. Portions of the inner peripheral surface 10*a* which are adjacent to the front side of the engagement steps 17 slightly protrude toward the center of the bulb retention portion 10, and front surfaces 18*a* (see FIG. 8) of the protruding portions 18 are inclined so as to become farther from the center toward the front.

Figure 4:
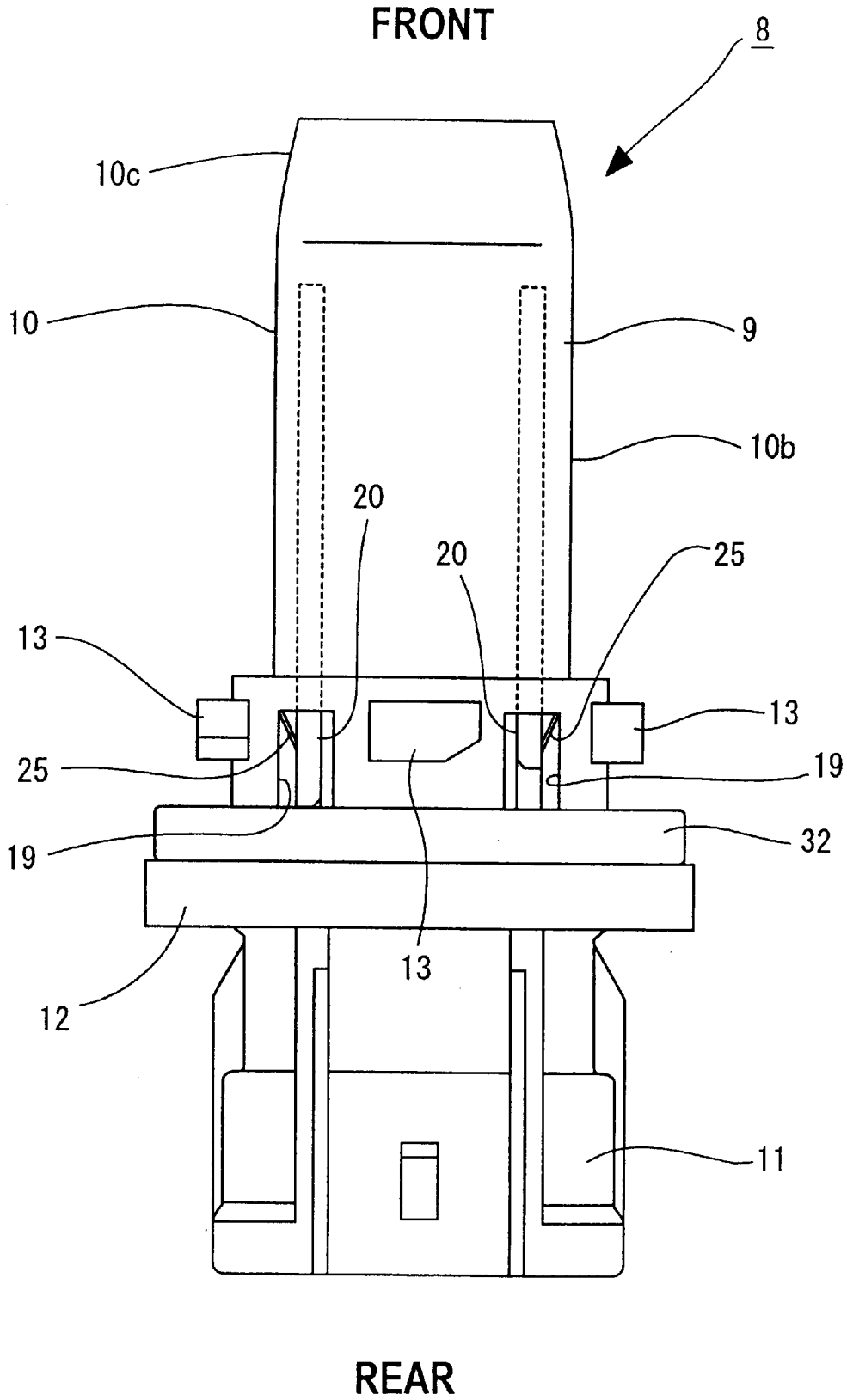
FIG. 4 is a side view thereof.

Pull-out holes 19 are opened in an outer peripheral surface 10*b* of the bulb retention portion 10 so that they are at locations close to the flange 12. The upper surfaces of the pull-out holes 19 and the engagement steps 17 are, as best seen from FIG. 8, on the same plane. In other words, when the socket main body 9 is molded, slide dies for forming the engagement steps 17 are positioned in the pull-out holes 19; and after molding, the slide dies are pulled out from the pull-out holes 19 (see FIG. 4 and FIG. 8).

In a typical method for molding surfaces which are positioned on a back side when seen from the front such as the surfaces of the engagement steps 17, dies for molding the engagement steps 17 are pulled out to the rear. In other words, such dies are pulled toward the connector case 11 and then removed. In such molding, so as for the dies to be pulled out, pull-out holes for dies need to be formed in the partition wall 14 in addition to the terminal insert holes 15. Therefore, if the size of a bulb socket is required to be reduced, the terminal insert holes 15 formed in the partition wall 14 overlap with the pull-out holes of the dies. Thus, in order to avoid the overlapping of the terminal insert holes 15 and the pull-out holes, part of the side wall of the connector case 11 needs to be cut out. This limits the shape of the connector portion.

However, in the bulb socket 8 of the present invention, the slide dies for forming the engagement steps 17 are pulled out in a direction parallel to the engagement steps 17 as indicated by an arrow in FIG. 7. Thus, the need for forming holes (pull-out holes) in addition to the terminal insert holes 15 in the partition wall 14 is eliminated; as a result, no restriction regarding the design is imposed.

The front end portion 10*c* of the outer peripheral surface 10*b* of the bulb retention portion 10 is tapered. In other words, the diameter of the front end portion 10*c* becomes smaller toward the front.

Two conducting terminals 20 are installed in the socket main body 9 that is as structured as described above.

Figure 10:
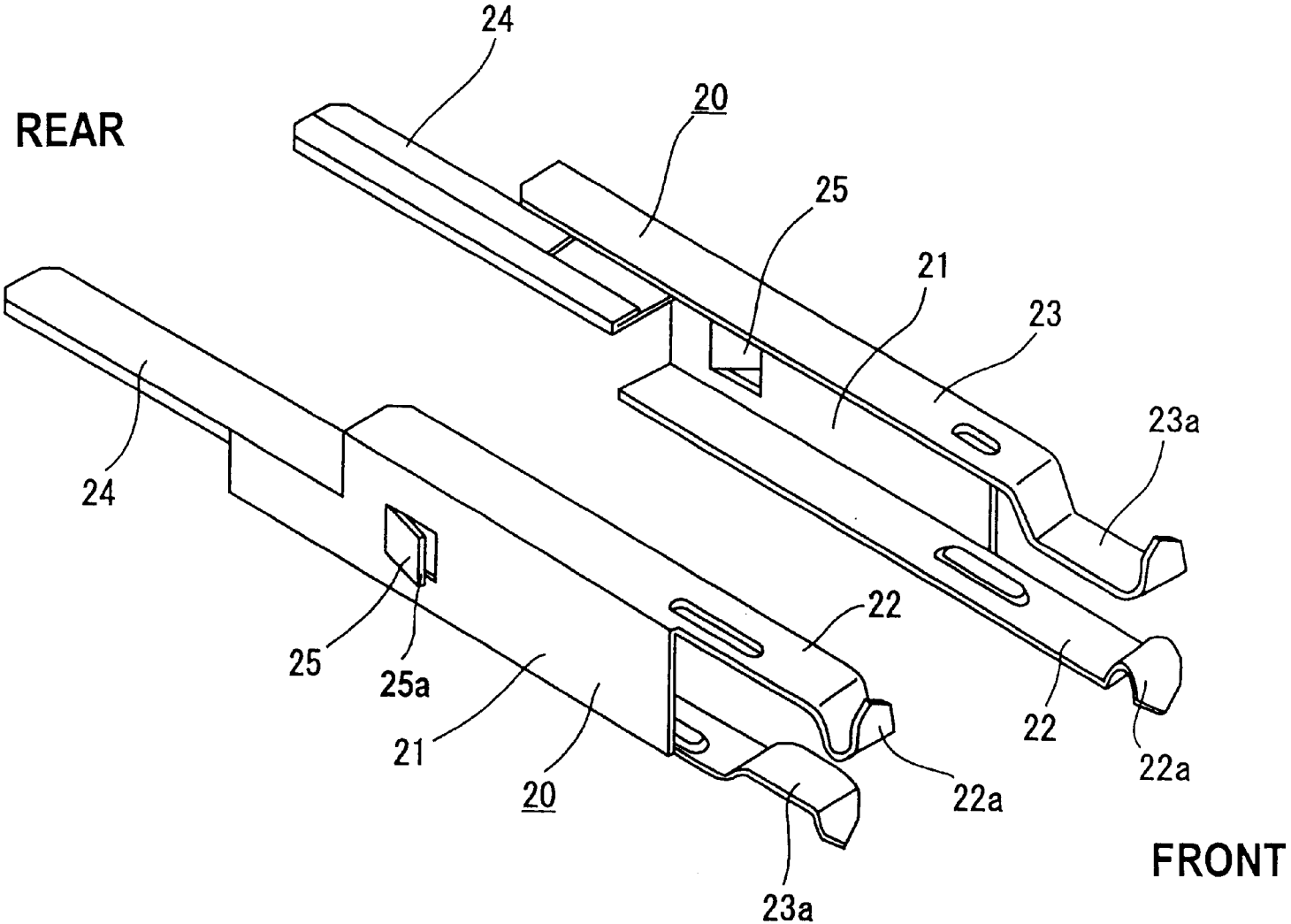
FIG. 10 is a perspective view of a pair of conducting terminals.

More specifically, as seen from FIG. 10, the conducting terminal 20 is formed from a metal plate that has conductivity and spring elasticity. The conducting terminal 20 is comprised of a main plate 21 and retention pieces 22 and 23. The main plate 21 is of an elongated shape, thus being a rectangular. The retention pieces 22 and 23 of a rectangular shape protrude in the same direction from both longer side edges of the main plate 21.

Front end portions of the retention pieces 22 and 23 protrude forward from the main plate 21. A front end of the retention piece 22 is bent toward the retention piece 23 so as to take a lateral U-shape, thus forming an engagement portion 22*a*. A front end of the retention piece 23 is bent toward the retention piece 22 so as to take an elongated C-shape, thus forming a contact portion 23*a*. A connector terminal 24 protrudes toward the rear from the back end of the main plate 21.

An engagement piece 25 is formed in a cut-and-erected state at a location near the rear end of the main plate 21. The engagement piece 25 protrudes obliquely in a direction opposite to the direction in which the retention pieces 22 and 23 protrude.

A pair of thus structured conducting terminals 20 are installed in the bulb retention portion 10. More specifically, the conducting terminals 20 are inserted into the bulb retention portion 10 through the front end of the bulb retention portion 10; and when inserted, the connector terminals 24 of the conducting terminals 20 are first brought into the bulb retention portion 10 and then the conducting terminals 20 are pushed into the bulb retention portion 10 for the entirety.

Figure 3:
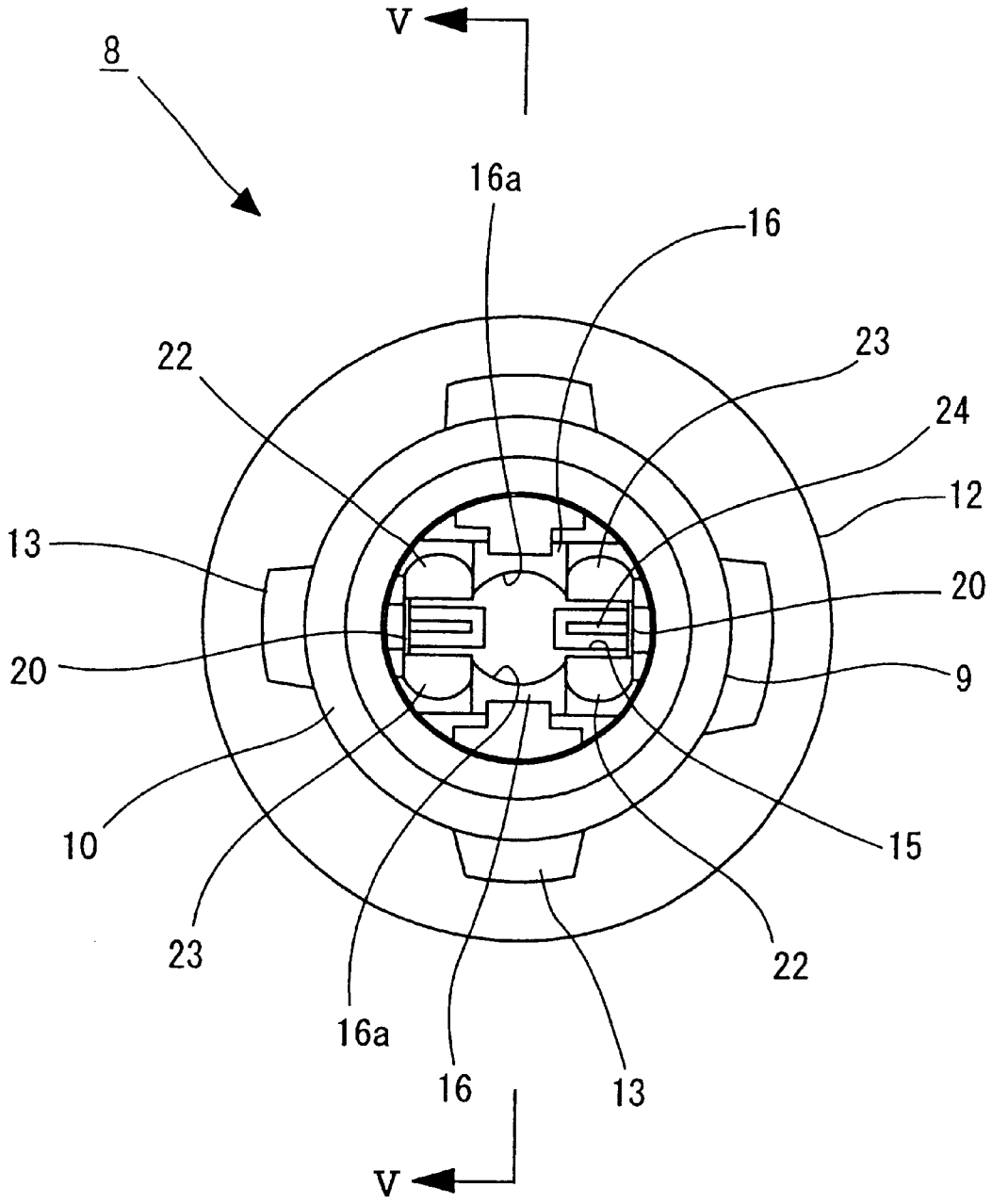
FIG. 3 shows the front end of the bulb socket according to the present invention.

The conducting terminals 20 are inserted so that the conducting terminals 20 are, as best seen from FIG. 3, set in both ends of the space between the dividing walls 16 of the bulb retention portion 10 with the main plates 21 being positioned on the inner peripheral surface 10*a* side of the bulb retention portion 10. The retention pieces 22 and 23 of the conducting terminals 20 are positioned in the grooves 16*b* at both end portions of the dividing walls 16 (see FIG. 3), and the connector terminals 24 of the conducting terminals 20 are inserted into the terminal insert holes 15 of the partition wall 14 so as to be in the connector case 11 as seen from FIG. 5.

In addition, when the conducting terminals 20 are inserted in the bulb retention portion 10, the engagement pieces 25 formed in the main plates 21 of the conducting terminals 20 pass the protruding portions 18 while sliding on the inclined surfaces 18*a* (see FIG. 8); and finally the engagement pieces 25 engage, at their front ends 25*a*, with the engagement steps 17. This engagement prevents the conducting terminals 20 from slipping toward the front in the socket main body 9 (see FIG. 5).

In the present invention, the pull-out holes 19 are opened in the side surfaces of the bulb retention portion 10. Accordingly, the engagement pieces 25 engaged with the engagement steps 17 can be seen through this pull-out hole or windows 19. Thus, it is possible to determine whether or not the engagement pieces 25 of the conducting terminals 20 are in engagement with the engagement steps 17 through the pull-out holes or windows 19 (see FIG. 4).

As seen from FIG. 5, the front ends of the retention pieces 22 and 23 of the conducting terminals 20 are set on the placement surfaces 16*c* of the dividing walls 16.

The bulb socket 8 is formed as described above. The above-described connector case 11 and the connector terminals 24 that protrude into the connector case 11 form the connector portion of the bulb socket 8.

Figure 6:
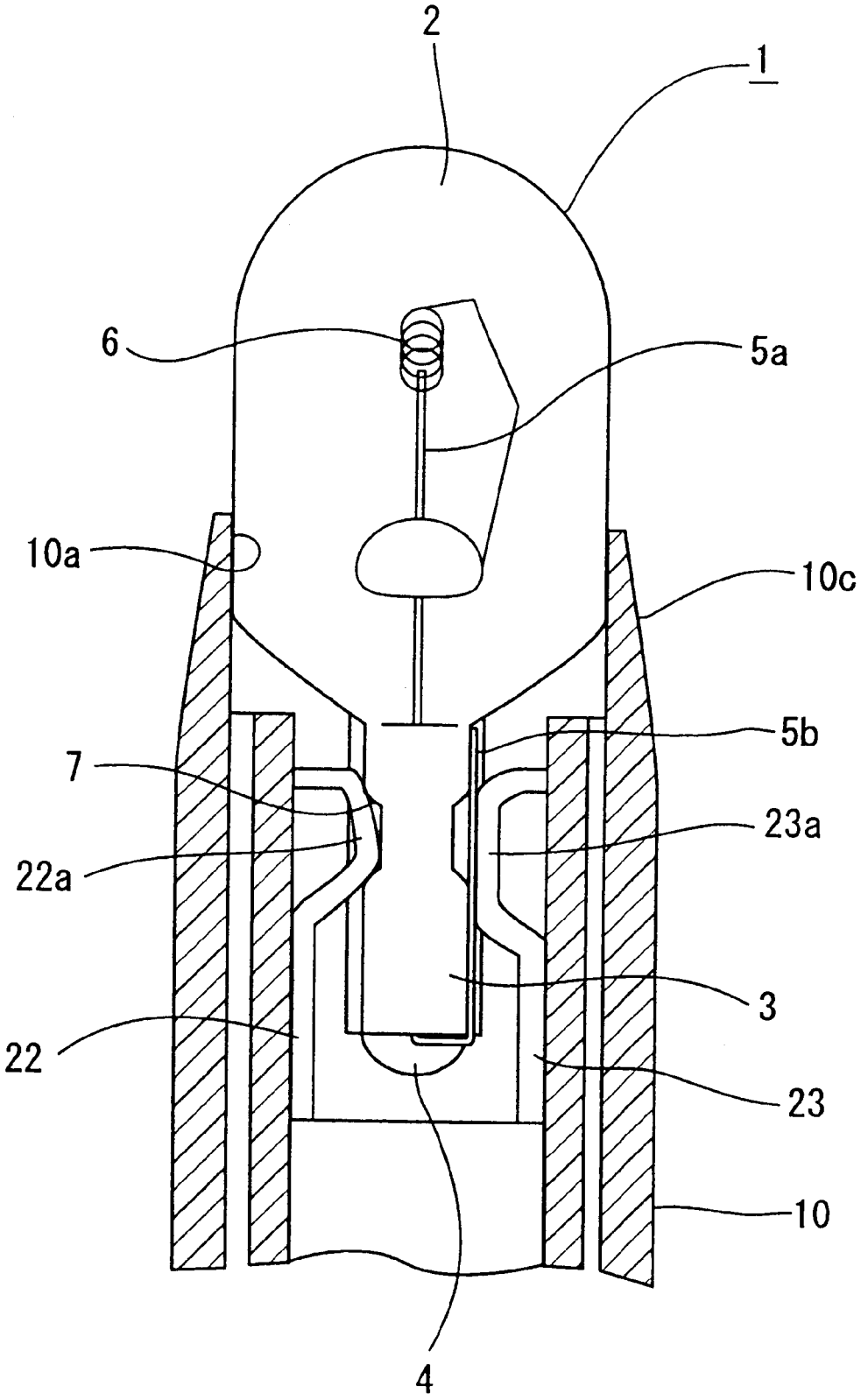
FIG. 6 is an enlarged cross sectional view of an essential portion of the bulb socket of the present invention with a bulb attached therein.

The wedge-base bulb 1 is inserted into the bulb retention portion 10 of the thus structured bulb socket 8 from its sealing element 3 side. As a result, as seen from FIG. 6, both sides of the sealing element 3 of wedge-base bulb 1 are set between the retention pieces 22 and 23 of the conducting terminals 20, and the exhaust pipe 4 of wedge-base bulb 1 is positioned between the concave surfaces 16*a* of the dividing walls 16.

More specifically, when the wedge-base bulb 1 is thus inserted in the bulb retention portion 10, the engagement portion 22*a* of the retention piece 22 of the conducting terminal 20 engages with the engagement concave groove 7 of the sealing element 3 of the bulb socket 8. Also, both sides of the sealing element 3 are sandwiched between the retention pieces 22 and 23 of the conducting terminals 20 with the contact portion 23*a* of the retention piece 23 in contact with the outer lead wires 5*b*. In addition, the exhaust pipe 4 of the bulb 1 is held by the concave surfaces 16*a* of the dividing walls 16, and the outer peripheral surface of the glass bulb 2 of the bulb 1 is retained by the inner peripheral surface 10*a* of the bulb retention portion 10.

The wedge-base bulb 1 is thus reliably retained by the bulb retention portion 10 of the bulb socket 8.

Figure 11:
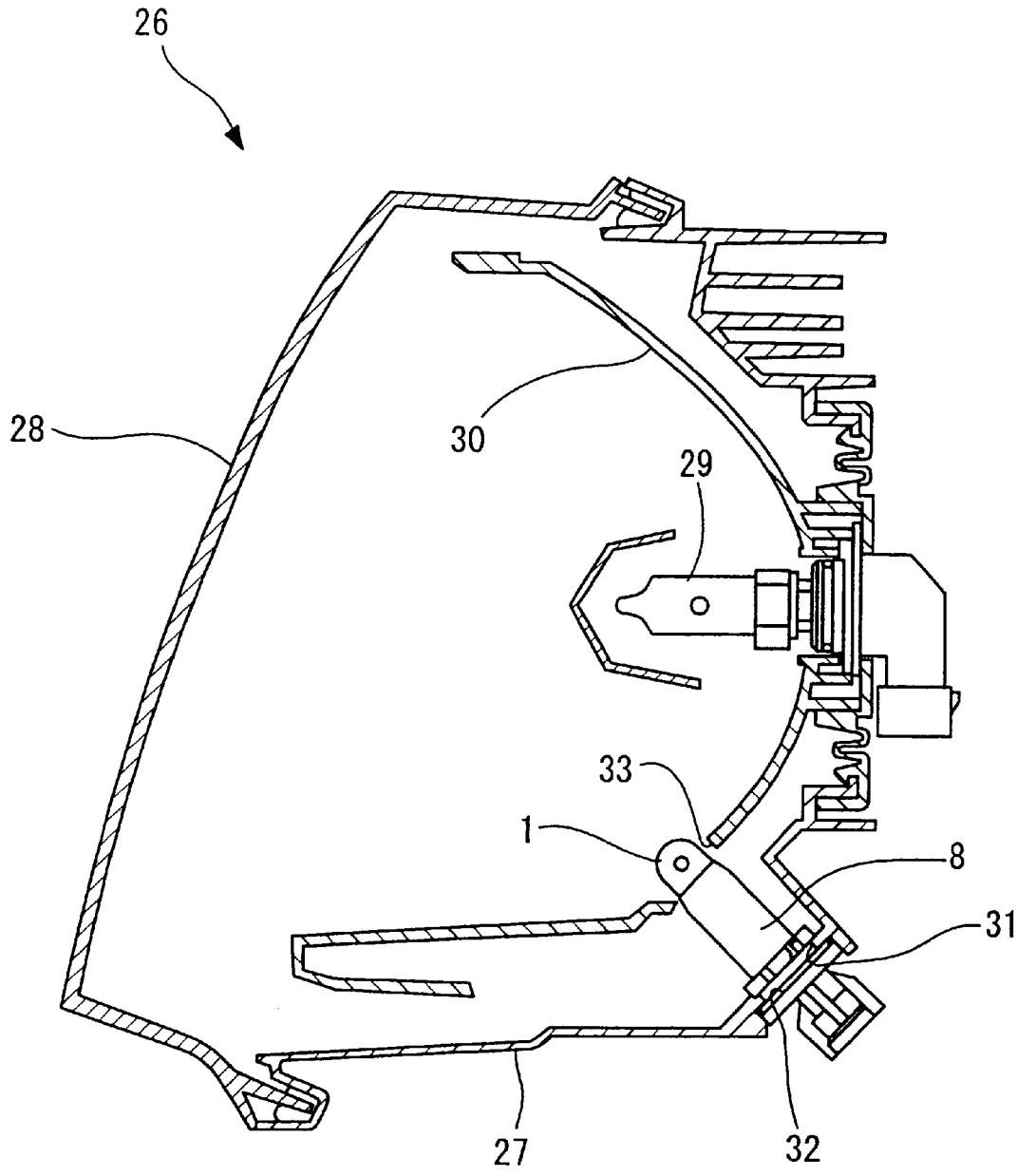
FIG. 11 shows a vehicle lamp in cross section with the bulb socket of the present invention installed.

FIG. 11 shows one of the manners the above-described bulb socket 8 is used.

In FIG. 11, the reference numeral 26 denotes a head lamp for an automobile. The opened front of a lamp body 27 is covered by a front cover 28, and a reflector 30 that supports a bulb 29 is tiltably installed in the lamp body 27.

The bulb socket 8 is attached to the lamp body 27 such that an aperture edge of an attachment hole 31 formed in the lamp body 27 is sandwiched by the flange 12 and the engagement protruding portions 13. A packing 32 is inserted between the flange 12 and the lamp body 27. Then, the bulb socket 8 with the wedge-base bulb 1 attached thereto is inserted into a circular insert hole 33 formed in the reflector 30. As a result, the wedge-base bulb 1 functions as a clearance lamp.

As a tendency of recent head lamps for automobiles, the front cover 28 is a so-called plain glass that has no lens steps, and the distribution of light is controlled by, for instance, fine reflection steps formed in the reflector 30. In such a case, since the insert hole 33 for the wedge-base bulb 1 is completely visible through the plain glass front cover 28, it is preferable that the insert hole 33 be designed as small as possible.

If the insert hole 33 is made small, when the reflector 30 is tilted, the edge of the insert hole 33 may interfere with the front end portion of the bulb socket 8. Therefore, it is preferable that the front end of the bulb socket 8, that is, the front end portion of the bulb retention portion 10, be as small as possible. Thus, as described above, in the present invention, the outer shape of the bulb retention portion 10 is cylindrical, and further, the front end portion 10*c* thereof is tapered. As a result, the risk of interference with the edge of the insert hole 33 when the reflector 30 is tilted can be reduced.

In addition, the insert hole 33 of the reflector 30, the outer shape of the glass bulb 2 of the wedge-base bulb 1, and the front end portion 10*c* of the bulb socket 8 are all made circular uniformly. Accordingly, the appearance when seen through the front cover 28 is better compared to the case where there is one of a different shape among them.

All of the shapes and structures of the elements described in the above are only examples used in the implementation of the present invention. The technical scope of the present invention should not be interpreted to be limited to them.

As is obvious from the above description, the bulb socket according to the present invention is for retaining a bulb that is comprised of a glass bulb enclosing a filament therein and a flat sealing element formed continuous to one end of the glass bulb, and a lead wires led out of the end of the sealing element are disposed on the flat surface of the sealing element; and in the present invention, the bulb socket comprises a cylindrical bulb retention portion and conducting terminals which are installed in the bulb retention portion, retain the sealing element of the bulb and are in contact with the lead wire. Each conducting terminal has an engagement piece that is engaged with an engagement step formed in the bulb retention portion so as to keep the conducting terminal in the bulb retention portion. In addition, a pull-out hole for a die for molding the engagement step that extends nearly perpendicular to a direction in which the bulb is inserted is opened so as to penetrate the wall of the bulb retention portion.

Accordingly, since the engagement step is visible from the outside through the pull-out hole, it is possible to determine whether or not the engagement piece of the conducting terminal inserted into the socket is engaged with the engagement step of the socket.

In addition, when the bulb socket of the present invention is manufactured, the die for molding the engagement step is pulled out in the direction nearly perpendicular to the direction in which the bulb is inserted, no hole other than the terminal insert hole is formed in the partition wall between the bulb retention portion and the connector portion. Thus, the design of the socket is not restricted.

Further, in the present invention, the front end portion of the bulb retention portion is tapered. Accordingly, the front end portion of the socket is small, avoiding the contact with a reflector of an automobile lamp.

Furthermore, in the present invention, since the cross-sectional shape of the front end portion of the bulb retention portion is circular, it matches the shape of the bulb retained in the bulb retention portion, enhancing the appearance.

What is claimed is:

1. A bulb socket for retaining a bulb, said bulb comprising a glass bulb that encloses a filament therein and a flat sealing element continuous to one end of said glass bulb, a lead wire led out from an end of said flat sealing element being disposed on a flat surface of said sealing element, wherein said bulb socket comprises:

a cylindrical bulb retention portion and a conducting terminal provided inside said bulb retention portion, said conducting terminal for retaining said flat sealing element of said bulb and being in contact with said lead wire, and wherein said conducting terminal is formed with an engagement piece that is engaged with an engagement step formed in said bulb retention portion, thus allowing said conducting terminal to be kept inside said bulb retention portion; and a pull-out hole that allows a die for molding said engagement step which extends substantially perpendicular to a direction in which said bulb is inserted is provided so as to penetrate an outer wall of said bulb retention portion.

2. The bulb socket according to claim 1, wherein a front end portion of said bulb retention portion is tapered.

3. The bulb socket according to claim 1, wherein a cross-sectional shape of a front end portion of said bulb retention portion is circular.

4. The bulb socket according to claim 2, wherein a cross-sectional shape of a front end portion of said bulb retention portion is circular.

5. A bulb socket for retaining a bulb, said bulb comprising a glass bulb that encloses a filament therein and a flat sealing element that is provided at one end of said glass bulb and has an engagement groove, said bulb socket comprising:

a hollow bulb retention portion provided with a window in a circumference thereof and with an engagement step formed on an inner surface thereof; and a conducting terminal provided inside said bulb retention portion so as to make an electrical contact with said bulb and formed with an engagement piece that engages with said engagement step of said bulb retention portion so as to keep said conducting terminal inside said bulb retention portion, said engagement piece being provided so as to positionally correspond to said window of said bulb retention portion so that said engagement piece and said engagement step are visible from outside of said bulb retention portion through said window.

* * * * *